US006111179A

United States Patent [19]

Miller

[11] Patent Number: 6,111,179

[45] Date of Patent: Aug. 29, 2000

[54] ELECTRONIC MUSICAL INSTRUMENT HAVING GUITAR-LIKE CHORD SELECTION AND KEYBOARD NOTE SELECTION

[76] Inventor: Terry Miller, 4606 Cedar Springs #2024, Dallas, Tex. 75219

[21] Appl. No.: 09/085,350

[22] Filed: May 27, 1998

[51] Int. Cl.[7] ..... G10C 3/12

[52] U.S. Cl. ..... 84/442; 84/423 R; 84/479 A; 84/669; 84/744; 84/DIG. 22

[58] Field of Search ..... 84/267, 423 R, 84/470 R, 477 R, 479 R, 479 A, 442, 443, DIG. 15, DIG. 22, 613, 637, 669, 715, 744, 743

[56] References Cited

U.S. PATENT DOCUMENTS

| | | | |
|---|---|---|---|
| D. 256,366 | 8/1980 | Dworsky | 17/1 |
| D. 278,917 | 5/1985 | Sinkoff | D17/1 |
| D. 289,900 | 5/1987 | Aitken et al. | D17/14 |
| D. 342,543 | 12/1993 | Reisman | D17/1 |
| 2,845,831 | 8/1958 | Hammond | 84/423 |
| 3,001,434 | 9/1961 | Lo Duca | 84/443 |
| 3,013,462 | 12/1961 | Combs, Sr. | 84/443 |
| 3,104,581 | 9/1963 | Berwin | 84/171 |
| 3,272,058 | 9/1966 | Haviland | 84/443 |
| 3,541,912 | 11/1970 | Radke | 84/1.17 |
| 3,845,684 | 11/1974 | Herr | 84/1.01 |
| 3,908,502 | 9/1975 | Kidd et al. | 84/1.01 |
| 3,941,023 | 3/1976 | Thomas et al. | 84/1.01 |
| 4,078,464 | 3/1978 | Sugiyama | 84/1.01 |
| 4,300,430 | 11/1981 | Bione et al. | 84/1.01 |
| 4,378,720 | 4/1983 | Nakada et al. | 84/1.03 |
| 4,428,269 | 1/1984 | Bione et al. | 84/1.01 |
| 4,545,276 | 10/1985 | Curletto | 84/1.01 |
| 4,932,304 | 6/1990 | Franzmann | 84/671 |
| 5,691,490 | 11/1997 | Williams | 84/170 |

FOREIGN PATENT DOCUMENTS

| | | |
|---|---|---|
| 2557721 | 5/1985 | France . |
| 1217186 | 5/1966 | Germany . |
| 3184076 | 8/1991 | Japan . |

*Primary Examiner*—Robert E. Nappi
*Assistant Examiner*—Wesley Scott Ashton
*Attorney, Agent, or Firm*—Goldstein & Canino

[57] ABSTRACT

A musical instrument, comprising a neck and a body. A chord selector is present on the neck, and a note selector is present on the body. The chord selector comprises a plurality of locations, each having a tonic and a quality. The note selector is a touch sensitive strip that is linearly arranged like a piano keyboard. A note is sounded only if it is simultaneously pressed on the note selector, and is present in one of the chords selected on the chord selector. Thus, once a chord is selected, it may be picked, strummed, or arpeggiated by employing different hand motions upon the note selector.

8 Claims, 3 Drawing Sheets

| | | | | | | | | | | | | | | | | | | | | | | | |
|---|---|---|---|---|---|---|---|---|---|---|---|---|---|---|---|---|---|---|---|---|---|---|---|
| C# | F# | B | E | A | D | G | C | F | Bb | Eb | Ab | Db | Gb | Cb | | | | | | | | | |
| A#m | D#m | G#m | C#m | F#m | Bm | Em | Am | Dm | Gm | Cm | Fm | Bbm | Ebm | Abm | | | | | | | | | |
| B# dim | E# dim | A# dim | D# dim | G# dim | C# dim | F# dim | B dim | E dim | A dim | D dim | G dim | C dim | F dim | Bb dim | | | | | | | | | |
| C# aug | F# aug | B aug | E aug | A aug | D aug | G aug | C aug | F aug | Bb aug | Eb aug | Ab aug | Db aug | Gb aug | Cb aug | | | | | | | | | |
| C#5 | F#5 | B5 | E5 | A5 | D5 | G5 | C5 | F5 | Bb 5 | Eb 5 | Ab 5 | Db 5 | Gb 5 | Cb 5 | | | | | | | | | |

331 332 333 334 335 30 38 35 37 34 35 31 33

FIG. 2

ELECTRONIC MUSICAL INSTRUMENT HAVING GUITAR-LIKE CHORD SELECTION AND KEYBOARD NOTE SELECTION

FIELD OF THE INVENTION

The invention relates to an electronic musical instrument. More particularly, the invention relates to an electronic instrument which is shaped like a guitar, having a neck portion and a body, wherein chords are selected with one hand by pressing upon specific locations on the neck, and notes within the selected chords are selectively played by pressing or strumming a touch sensitive strip which simulates the layout of a conventional piano keyboard.

BACKGROUND OF THE INVENTION

All music begins in the brain of the musician, who attempts to communicate his musical thoughts through the use of a musical instrument. No musical instrument provides a perfect link with the brain to allow the musician to completely express his musical thoughts. All instruments have inherent advantages and disadvantages when compared with each other.

The piano keyboard is perhaps the most logically laid-out musical instrument. The notes are arranged from lowest pitch to highest pitch. A repeating pattern comprising seven white keys and five black keys extend from left to right. The C major scale is represented by all the white keys, while an E flat pentatonic scale is represented by all the black keys. Put another way, the white keys are natural notes, and the black keys are accidentals. When reading a musical staff, traveling upward on the staff corresponds to traveling to the right on the keyboard. It is easy, even for a novice, to find a corresponding note on the piano keyboard when reading the musical staff.

One of the major expressive limitations of the keyboard is the manner in which each of the keys are played. The key is pressed to sound the note which that key represents. Most modern electronic keyboards, and traditional acoustic pianos, provide "touch sensitivity". Thus, when the key is struck harder, it will produce a loud sound. By controlling the velocity with which the keys are struck, the keyboardist can control the "dynamics" of the music he produces. However, the only control that a keyboard player has over that note is the loudness. It is very difficult for the keyboard player to "vamp" on a particular note or chord, play rapid arpeggiated versions of that chord, or to repeatedly play a single note rapidly.

Even the modern portable electronic keyboard has a further disadvantage, in that it is typically a stationary instrument—it is not easy for a keyboardist to play his instrument while carrying it around. Attempts at providing "strap-on" keyboards in the early eighties were largely unsuccessful. This is due to the fact that the keyboard requires that the player maintain a similar wrist angle across the entire keyboard in order to sustain playing dexterity. Thus, when a keyboard is diagonally supported around one's neck, certain areas of the keyboard are easier to play than others. In addition, only one handed playing is possible when using a strap-on keyboard.

The guitar answers many of the expressive limitations of the keyboard. The guitar allows the player to vary the sound of a particular note by varying the "picking style" employed. The guitar also allows the player to rapidly and repeatedly "strum" a note or chord, or to easily arpeggiate that chord.

Further, the guitar is very easily played while standing. The guitar straps onto the player's body, wherein the left hand is typically employed for fretting the notes along the neck of the guitar, while the right hand picks the strings at the body of the guitar.

However, the main limitation of the guitar is the seemingly illogical layout of the guitar. The standard guitar has six strings. As one moves along the neck toward the body on any given string, the pitch increases. Some adjacent strings are separated by different intervals than other adjacent strings. Playing the guitar requires significant memorization to understand the various fingerings required to play different chords. There is no easy way to distinguish accidentals and naturals on a guitar fret-board. There is no easy way to play a major or minor scale on a guitar without memorizing a specific sequence of movements.

Thus, there is a need to provide an instrument which combines to logical arrangement of the keyboard with the expressive capabilities of the guitar.

U.S. Design Pat. No. 278,917 to Sinkoff et al; U.S. Des. Pat. No. 289,900 to Aitken et al; U.S. Des. Pat. 256,366 to Dworsky; and U.S. Des. Pat. No. 342,543 to Reisman each disclose different designs for a hand-held musical instrument, which each attempt to mimic the guitar in structure and playing position.

U.S. Pat. No. 3,541,912 to Radke discloses a manual and chord button bank portable-necked body for an electric organ. In particular, Radke discloses a device which is shaped like a guitar, wherein an ordinary keyboard is provided at the body, and two rows of buttons are arranged along the neck. A first row of button will activate a single (tonic) note. A second row of buttons comprises two buttons which are adjacent to each button on the first row. When either or both of the second row buttons adjacent to the first row button is also pressed, either a two note or three note major chord will be played. However, it seems that Radke is limited to only producing major or dominant chords.

While these units may be suitable for the particular purpose employed, or for general use, they would not be as suitable for the purposes of the present invention as disclosed hereafter.

SUMMARY OF THE INVENTION

The present invention relates to an electronic musical instrument. More particularly, the invention relates to an electronic instrument which is shaped like a guitar, having a neck portion and a body, wherein chords are selected with one hand by pressing upon specific locations on the neck, and notes within the selected chords are selectively played by pressing or strumming a touch sensitive strip which simulates the layout of a conventional piano keyboard.

It is an object of the invention to provide a musical instrument which has the advantages of both keyboard and guitar instruments, while eliminating disadvantages thereof which would otherwise tend to interfere with the musician's musical expression. Accordingly, aspects of both the linear nature of the traditional keyboard, and fret-like chord selection of the guitar are incorporated into a guitar-shaped musical instrument.

It is another object of the invention to provide a logical chord selection system which allows a large variety of chords to be selected. Accordingly a grid is provided on the neck, comprised of rows and columns, including a first row which represents the tonic note major chords, while additional rows are provided to select minor, diminished, and augmented triads, as well as fifths, which are used in combination to produce the most commonly played chords and scales.

It is a still further object of the invention to provide a chord selection system which allows easy selection of a wide variety of chords within easy reach of a single hand. Thus, adjacent buttons in each row are separated by a fourth; the second row is the relative minor for the first row in the same column; the third row is the diminished chord of the flatted tonic from the first row in that column; the fourth row is the augmented chord with the same tonic as the first row in that column; and the fifth row is the fifth of the tonic of the first row in that column.

It is yet a further object of the invention, that the musical instrument allows easy selection and distinct sounding of various notes within the selected chords. Accordingly a strip which resembles a piano keyboard is provided. The strip allows selection of the different notes within the selected chord, and allows easy arpeggiation, "picking", and "strumming" of the notes within said chord.

Accordingly, the invention is a musical instrument, comprising a neck and a body. A chord selector is present on the neck, and a note selector is present on the body. The chord selector comprises a plurality of locations, each having a tonic and a quality. The note selector is a touch sensitive strip that is linearly arranged like a piano keyboard. A note is sounded only if it is simultaneously pressed on the note selector on the body, and is present in one of the chords selected on the chord selector on the neck. Thus, once a chord is selected, it may be picked, strummed, or arpeggiated by employing different hand motions upon the note selector.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 2 is a top plan view, illustrating the chord selection part.

DETAILED DESCRIPTION OF THE PREFERRED EMBODIMENTS

Figure 1:
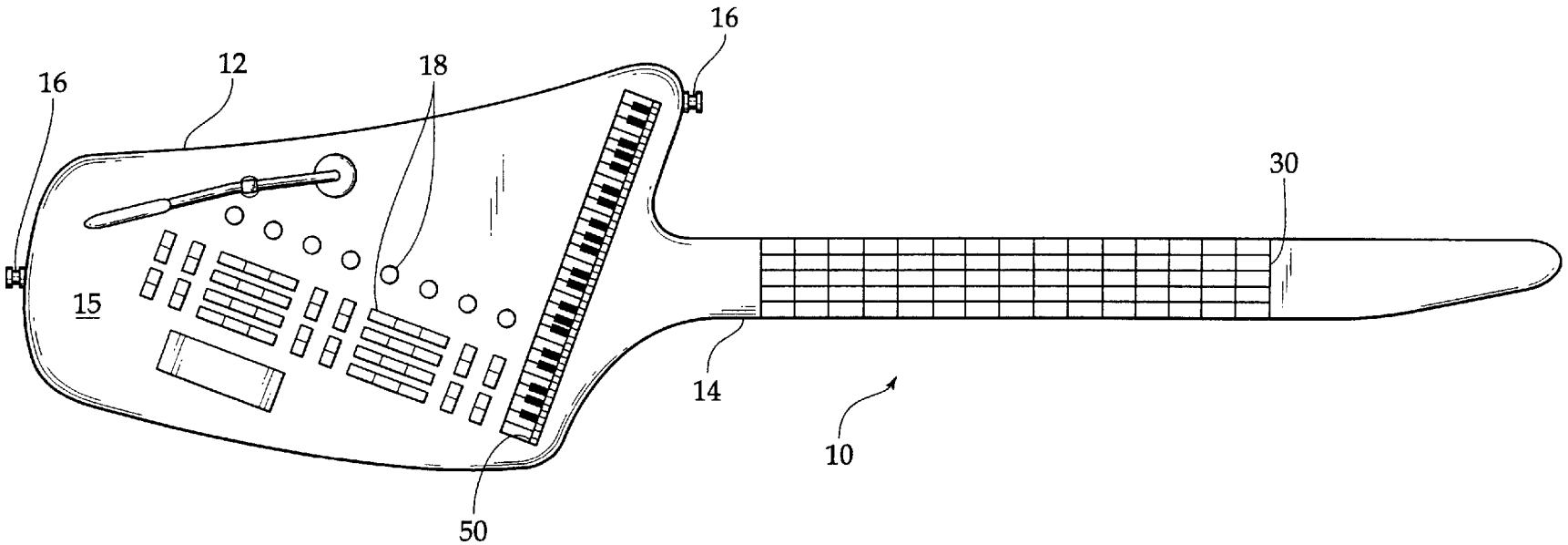
FIG. 1 is a top plan view of the invention, illustrating the chord selection part, and the note selection part thereof.

FIG. 1 illustrates a musical instrument 10, comprising a body 12 and a neck 14. The body 12 and neck 14 share a common front face 15. A pair of strap connectors 16 are provided on the body so that the instrument 10 may be supported by a player, around the player's neck, with a strap.

The musical instrument has a chord selector 30 and a note selector 50. The chord selector 30 is located on the neck 14, and the note selector 50 is located on the body 12. Both the chord selector 30 and note selector 50 are present on the front face 15.

The musical instrument also has sound and rhythm controls 18, which are used to selectively choose timbres for notes played by the note selector 50 in conjunction with the chord selector 30. Creation of these sounds, and the type of sound controls that may be provided are well known by those of ordinary skill in the art. Further the inventive concept herein relates to a system for selecting and playing chords and notes, which then can be played with an infinite variety of sounds. Thus, discussion of specific sound creation controls and circuitry is beyond the scope of the discussion herein.

With reference now to FIG. 2, the chord selector 30 is detailed. The chord selector is a grid of distinct locations 31, preferably in arranged five rows 33 and fifteen columns 34. The rows 33 include a first row 331, second row 332, third row 333, fourth row 334, and fifth row 335.

Each location 31 on the chord selector selects a distinct chord, having a tonic and a quality, which is labeled with indicia 35 which provides the conventional notation for the chord. For example, location 37 has indicia 35 labeled "C", which refers to a C major chord. Thus pressing location 37 selects a C major chord, having the notes C, E, and G. For the C major chord, "C" is the tonic note an "major" is the quality.

According to the present invention, however, more than one location may be selected simultaneously. For example location 38 with indicia 35 labeled "Em", refers to an "E minor" chord. The E minor chord has notes E, G, and B. Thus, if locations with indicia labeled "C" and "Em" are pressed simultaneously, the notes C, E, G, and B are selected. Thus, a "C Major 7" chord is selected.

Another example of dual chord selection involves selection of the location with indicia labeled "E dim", referring to an E diminished chord. The E diminished chord has notes E, G, and Bb. Thus, if location with indicia labeled "C" and "E dim" are selected simultaneously, the notes C, E, G, and Bb are selected. Thus, a "C7" chord is selected.

An example for selection of a minor 7 chord entails selecting the locations with indicia labeled "Dm" and "F". The D minor chord has the notes D, F, and A. The F major chord has the notes F, A, and C. Thus, if locations with indicia labeled "Dm" and "F" are pressed simultaneously, the notes D, F, A, and C are selected. Thus, a "D minor 7" chord is selected.

An example for selecting a suspended chord entails selecting the locations with indicia labeled "C5" and "F5". The C fifth harmony has the notes C and G. The F fifth harmony has the notes F and C. Thus if locations "C5" and "F5" are pressed simultaneously, the notes C, F, and G are selected. Thus, a "C sus" chord is selected.

A further example using multiple chord selection for selecting a 7th suspended chord entails selecting the locations with indicia labeled "C5", "F5", and "Bb5". The C fifth harmony has the notes C and G. The F fifth harmony has the notes F and C. The Bb fifth harmony has the notes Bb and F. Thus, if locations "C5", "F5", and "Bb" are pressed simultaneously, the notes C, F, G, and Bb are selected. Thus, a "C7 sus" chord is selected.

The different locations are arranged in a logical fashion. Adjacent locations in the same row are separated by a major fourth. Locations in the first row 331 select a major chord. Locations in the second row 332 select a minor chord, which is a minor third below the tonic of the location in the first row 331 of the same column 34. The chord selected by the second row 332 is also known as the "relative minor" of the chord in the first row 331 of the same column 34. Locations in the third row 333 select a diminished chord which is based on the flatted tonic of the location in the first row 331 of the same column 34. Locations in the fourth row 334 select an augmented chord which is based on the same tonic as the first row 331 of the same column 34. Locations in the fifth row 335 select a fifth harmony which is based on the same tonic as the first row 331 of the same column 34. This arrangement ensures that locations which would normally be selected to create the most common musical chord combinations are near each other.

Many more combinations of chords are possible, for example a C major scale may be created by pressing the three first row 331 locations with indicia "G", "C", and "F", referring of course to the G major, C major, and F major chords, which will select all the "natural" notes. These notes comprise the C major scale.

An example for creating a C harmonic minor scale involves pressing locations with indicia labeled "Cm", "D dim", and "B dim". The C minor chord has the notes C, Eb, and G. The D diminished chord has the notes D, F, and Ab. The B diminished chord has the notes B, D, and F. Thus, if locations "Cm", "D dim", and "B dim" are pressed simultaneously, the notes C, D, Eb, F, G, Ab, and B are selected. These notes comprise the C harmonic minor scale.

A further example for creating a C whole tone scale involves pressing locations labeled "C aug" and "D aug". the C augmented chord has the notes C, E, and G#. The D augmented chord has the notes D, F#, and A#. Thus, if locations with indicia labeled "C aug" and "D aug" are pressed simultaneously, the notes C, D, E, F#, G#, and A# are selected. These notes comprise the C whole tone scale.

Figure 3:
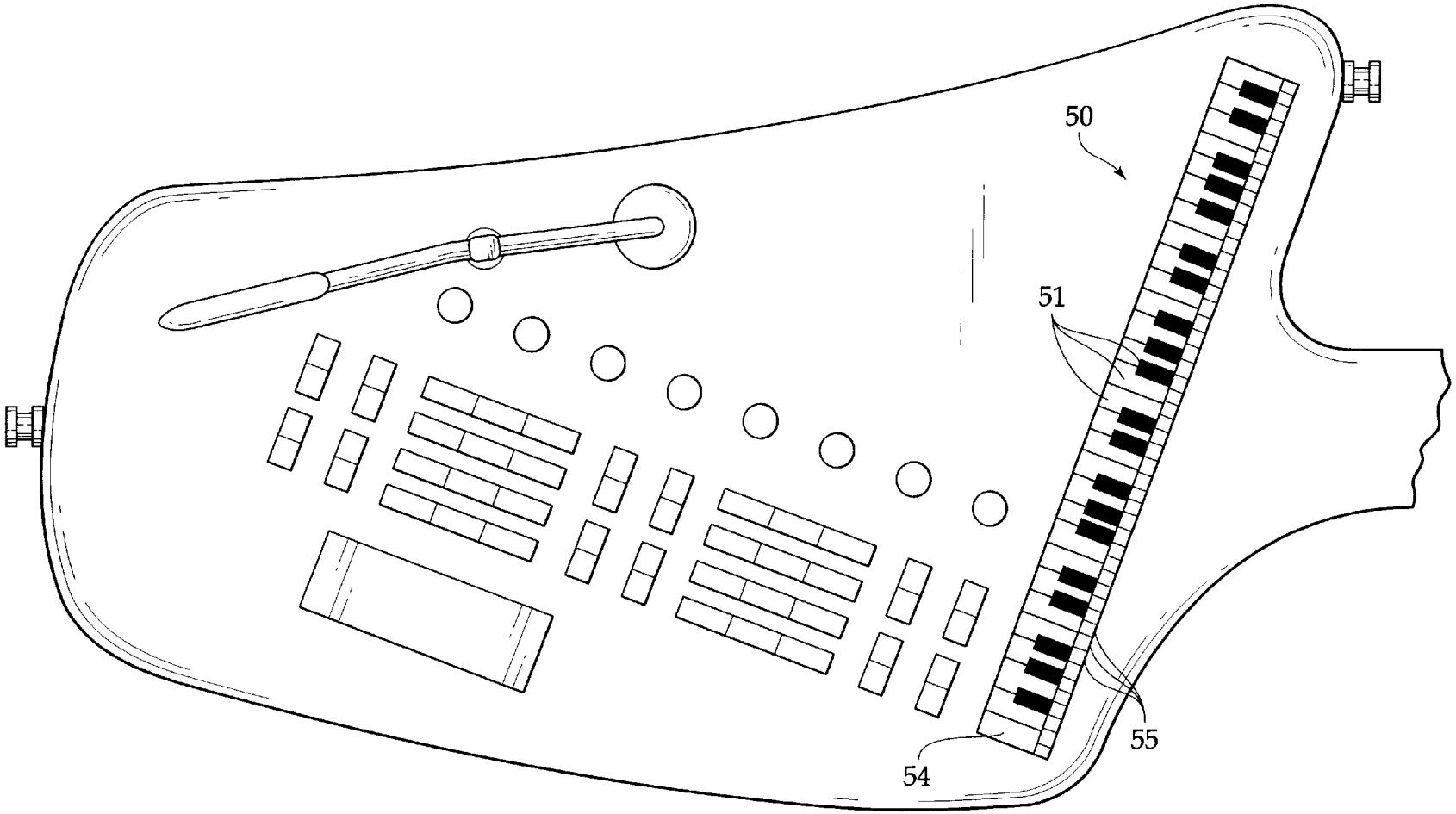
FIG. 3 is a top plan view, illustrating the note selection part.

The chords selected with the chord selector 30 as previously described are not necessarily sounded. The note sounding is controlled by the note selector 50, illustrated in FIG. 3. The note selector 50 is a linear arrangement of note positions 51, which are defined, shaped, and arranged according to a four octave portion of a conventional piano keyboard. The note selector 50 contains a plurality of electrical switches, each associated with one of the note positions 51.

The note selector 50 is made of a touch sensitive strip 54 which sounds a note only if the corresponding note position 51 is pressed and that note is contained within one of the chords that is simultaneously selected by the chord selector 30. Thus, if a C major chord is selected on the chord selector 30, only C, E, and G notes will sound if they are pressed on the note selector 50. No other notes will sound, even if they are pressed on the note selector 50. Further, the mere selection of the chord will not sound any notes, unless those notes are also played on the note selector 50.

The use of the touch sensitive strip 54 thus allows the notes of the chord to be individually "picked" with a precision tapping of the note selector; the entire chord in different inversions to be "strummed" with a quick repetitive motion across the note selector; and "arpeggiation" to be played by simply running one's finger rapidly upward and downward on the touch sensitive strip 54 in a controlled manner.

The touch sensitive strip 54 can be further sensitive to the velocity with which it is tapped, or pressure thereupon to control dynamics, or other aspects of the note tonality.

LED lights 55 are also provided on the note selector associated with each of the note positions 51, and located adjacent thereto. The LED lights 55 indicate the note positions 51 that are available for sounding because they are contained within the chord selected with the chord selector 30.

In conclusion, herein is presented a musical instrument in which chords are selected with a chord selector, and notes within the selected chord are sounded by note positions on a linear note selector which correspond to notes within the selected chords. A variety of different complex musical structures can be created by simultaneously selecting several chords, and employing different playing techniques upon the note selector.

What is claimed is:

1. A musical instrument, having a body and a neck, comprising:

a chord selector, having a plurality of locations, wherein each location designates a chord having a tonic note and a quality;

a note selector, having a plurality of note positions that are linearly arranged; and wherein a note is only sounded when its respective note position is pressed on the note selector and a chord containing said note is simultaneously selected on the chord selector.

2. The musical instrument as recited in claim 1, wherein the locations on the chord selector are arranged in a grid having a plurality of rows and a plurality of columns, the tonic note of adjacent locations in any row are separated by a major fourth.

3. The musical instrument as recited in claim 2, wherein the rows further comprise a first row and a second row, the first row selects a major chord of its tonic, the second row selects the relative minor of the tonic of the first row in that column.

4. The musical instrument as recited in claim 3, wherein the rows further comprise a third row, the third row selects a diminished chord based on the flatted tonic of the location in the first row in the same column.

5. The musical instrument as recited in claim 4, wherein the rows further comprise a fourth row, the fourth row selects an augmented chord based on the same tonic note as the location in the first row in the same column.

6. The musical instrument as recited in claim 5, wherein the rows further comprise a fifth row, the fifth row selects a fifth harmony based on the same tonic note as the location in the first row in the same column.

7. The musical instrument as recited in claim 5, wherein the chord selector allows simultaneous selection of two or more locations to create complex chord structures.

8. The musical instrument as recited in claim 6, further comprising a plurality of lights, each light associated with one of the note positions and located adjacent thereto, each light illuminating when that note position is contained within a chord selected with the chord selector.

* * * * *